US005566522A

United States Patent [19]

Ålander et al.

[11] Patent Number: 5,566,522

[45] Date of Patent: Oct. 22, 1996

[54] RIBBED PLATE FOR A COMPOSITE SLAB

[75] Inventors: Casper Ålander; Tarmo Mononen, both of Espoo, Finland

[73] Assignee: Rannila Steel Oy, Vimpeli, Finland

[21] Appl. No.: 318,724

[22] PCT Filed: Apr. 13, 1993

[86] PCT No.: PCT/FI93/00156

§ 371 Date: Oct. 20, 1994

§ 102(e) Date: Oct. 20, 1994

[87] PCT Pub. No.: WO93/21405

PCT Pub. Date: Oct. 28, 1993

[30] Foreign Application Priority Data

Apr. 13, 1992 [FI] Finland ..... 921642

[51] Int. Cl.[6] ..... E04C 2/26; E04B 5/40

[52] U.S. Cl. ..... 52/630; 52/334; 52/336; 52/449; 52/450; 52/674; 52/798.1; 428/183; 428/603

[58] Field of Search ..... 52/630, 336, 220.4, 52/334, 449, 450, 451, 452, 453, 783.11, 798.1, 636, 674, 675; 428/597, 603, 604, 179, 182, 183

[56] References Cited

U.S. PATENT DOCUMENTS

| | | | |
|---|---|---|---|
| 1,616,968 | 2/1927 | Hall | 428/603 X |
| 2,245,690 | 6/1941 | Krueger | 52/450 X |
| 3,462,902 | 8/1969 | Albrecht et al. | 52/336 |
| 3,760,549 | 9/1973 | Silberkuhl et al. | 52/630 |
| 3,812,636 | 5/1974 | Albrecht et al. | 52/630 X |
| 4,074,495 | 2/1978 | Bodnar | 52/630 X |
| 4,144,369 | 3/1979 | Wass | 52/450 X |
| 4,453,364 | 6/1984 | Ting | 52/450 X |
| 4,726,159 | 2/1988 | Stohs | 52/630 X |
| 4,793,113 | 12/1988 | Bodnar | 52/636 X |
| 4,962,622 | 10/1990 | Albrecht et al. | 52/630 |
| 5,287,671 | 2/1994 | Ueki | 52/630 X |

FOREIGN PATENT DOCUMENTS

| | | | |
|---|---|---|---|
| 38222 | 10/1981 | European Pat. Off. | 52/630 |
| 1559400 | 11/1970 | Germany . | |
| 2225273 | 12/1972 | Germany . | |
| 2225272 | 12/1972 | Germany . | |
| 2159959 | 6/1973 | Germany . | |
| 2339638 | 2/1975 | Germany | 52/336 |
| 416032 | 1/1967 | Switzerland . | |
| 654780 | 3/1979 | U.S.S.R. | 52/456 |
| 779538 | 11/1980 | U.S.S.R. | 52/630 |
| 1094581 | 12/1967 | United Kingdom . | |
| 1502133 | 2/1978 | United Kingdom | 52/450 |
| 2138860 | 10/1984 | United Kingdom | 52/630 |

*Primary Examiner*—Wynn E. Wood
*Assistant Examiner*—Laura A. Saladino
*Attorney, Agent, or Firm*—Burns, Doane Swecker & Mathis LLP

[57] ABSTRACT

The invention relates to a ribbed plate for a composite slab, the profile of which consists of protruding ribs formed in an essentially planar plate, the upper flanges of the ribs being surface profiled in order to achieve better adhesion between the ribbed plate and the concrete of the composite slab. According to the invention, the surface profiling of the upper flange of each rib consists of spaced apart corrugations extending essentially across the upper flange. Additionally, in the junction of the web between the sides of the rib and the upper flange there is formed a protruding longitudinal corrugation extending at least partly along a length of the rib.

15 Claims, 2 Drawing Sheets

RIBBED PLATE FOR A COMPOSITE SLAB

BACKGROUND OF THE INVENTION

1. Field of the Invention

The present invention relates to a ribbed plate for a composite slab.

2. Description of Related Art

In building with composite slabs, different profiled ribbed plates made of steel sheet are being used around the world, the steel sheets differing from each other mainly in their outward appearance. One of the most popular ribbed plates in Europe is a steel ribbed plate provided with dovetail-like ribs. Among the best properties of this plate is its favourable appearance, because its lower surface is relatively smooth, and the possibility of attaching heavy loads in the dovetail grooves of the plate by means of special brackets without making holes in the plate itself.

The weakness of, for example, the dovetail profile is, however, an imperfect adhesion to the concrete cast on the plate. Attempts to improve the adhesion have been made by increasing the pattern, for example, protuberances in the upper flange and web of the rib. The problem has, however, not been solved, but in some cases cost-increasing measures have been necessary, for example, deformation of the rib ends in a so called heading.

Because of the vertical component of the adhesion forces and the different bending stiffnesses of the ribbed plate and the concrete, the ribbed plate and the concrete show a tendency to disengage from each other, i.e. they repel each other, which for its part makes the adhesion between the ribbed plate and the concrete weaker. The weak adhesion and the repulsion reaction lead to brittle breaking behaviour. This has resulted in that reduction coefficients of durability have to be used in dimensioning, and essential limitations in the plasticity theoretical dimensioning.

OBJECTS AND SUMMARY

An object of the present invention is to achieve an improved ribbed plate by means of which a complete adhesion of the plate to the concrete is achieved and the above mentioned disadvantages are avoided. The ribbed plate according to the invention is characterized in that the junction of the web of the rib and the upper flange is formed as protruding longitudinal corrugations, and that the transverse corrugations are supported on the longitudinal corrugations and extend over them. The profile of the ribbed plate includes protruding ribs formed in an essentially planar plate, the upper flanges of the ribs being surface profiled in order to achieve better adhesion between the ribbed plate and the concrete of the composite slab, and in which plate the surface profiling of the upper flange of each rib is formed of spaced apart corrugations extending across the upper flange.

One of the advantages of the ribbed plate of the invention is a perfect adhesion to the concrete slab because the cooperation of the surface profiling and the concrete is ensured by a longitudinal corrugation preventing a repulsion reaction between the ribbed plate and the concrete. Hereby it is possible in normal conditions to utilize completely the strength of the plate in dimensioning and to ensure that the production costs are kept at a reasonable level. The adhesion of the ribbed plate to the concrete in a finished ribbed plate has, in fact, been found to be better than the adhesion of the ribbed plates of the competitors.

The other preferred embodiments of the invention are characterized by what is disclosed in the claims hereinbelow.

BRIEF DESCRIPTION OF THE DRAWINGS

In the following the invention will be described by means of examples with reference to the attached drawings, where.

DETAILED DESCRIPTION OF PREFERRED EMBODIMENTS

Figure 1:
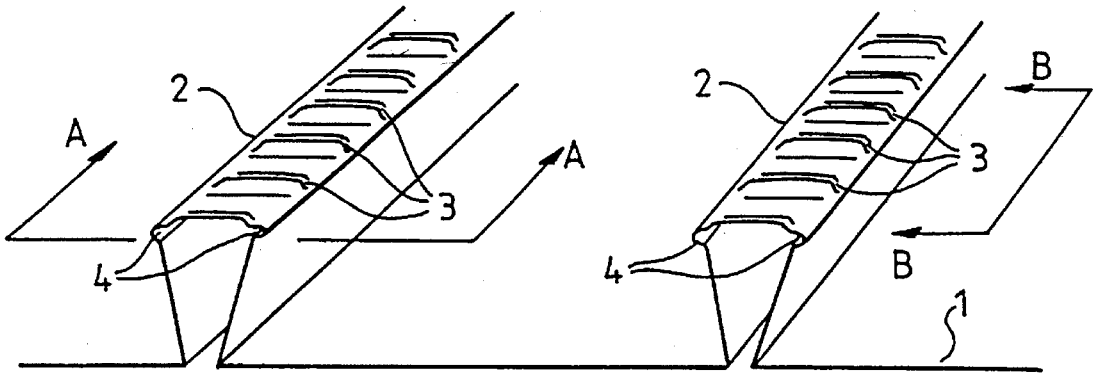
FIG. 1 is a top view in perspective of the ribbed plate of the invention.

FIG. 1 illustrates a ribbed plate 1 according to the invention comprising dovetail-like ribs 2. The novelty lies in the surface profiling of the upper flange of the ribs, which is formed of spaced apart transverse corrugations 3, and in the longitudinal corrugations 4 protruding from the upper edges of the rib.

Figure 2A:
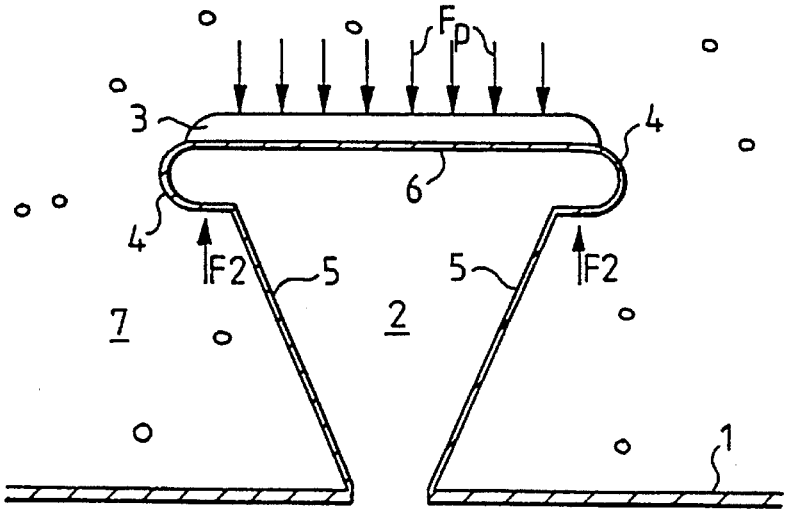
FIGS. 2*a* and 2*b* illustrate the intersections A—A and B—B according to FIG. 1 of the ribbed plate of FIG. 1, respectively.

FIG. 2*a*, in which the rib 2 of the ribbed plate 1 is illustrated in greater detail cast in the plate, shows that the upper edges of the ribs are formed as a longitudinal corrugation 4 of the junction of the web 5 of the rib and the upper flange 6. Thus the longitudinal corrugations 4 are supported on the concrete 7, whereby the rib cannot move in the downward direction or become disengaged from the concrete when the plate is bent.

Figure 2B:
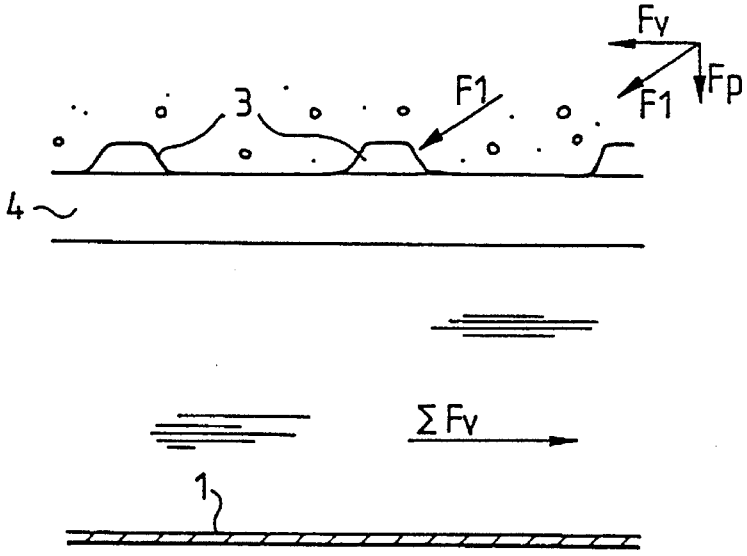

When the adherence of the ribbed plate to the concrete is ensured in this way, the transverse corrugations 3 in the upper flange of the rib can take up even great adhesion forces F1. The vertical and horizontal components $F_p$ and $F_v$ of the adhesion forces F1 acting on the ribbed plate have been gathered into the vector diagram in FIG. 2*b*. The transverse corrugations form micro beams supported vertically on the longitudinal corrugations 4, the vertical displacement of which is prevented by the support reaction force F2 of the vertical component $F_p$ of the adhesion force of the concrete (FIG. 2*a*). A vertical displacement would result in loss of the adhesion. Due to the support reaction forces F2 of the concrete the webs do not bend essentially.

The horizontal force $\Sigma F_v$, created by the bending strain of the ribbed plate, leads to compression stress in the concrete in front of the transverse corrugations, but because of the large number of the transverse corrugations 3 the force F1 (FIG. 2*b*) per corrugation is small enough so that there will not be any local breaks in the concrete that would lead to loss of the adhesion.

A feature of the invention is that an effective cooperation between the transverse corrugations 3 and the longitudinal corrugations 4 is achieved, said cooperation is for its part preferably obtained by making the transverse corrugations elongated, i.e., micro beams extending essentially across the upper flange 6 of the entire rib, and by forming a sufficient number of said corrugations on the upper flange of the rib.

In defining the dimensions of the corrugations 3 and the distance between them, one standard that can be used is a ribbed bar intended for reinforcement of concrete and having the ratio of the area of the projections of the ribs to the cross-sectional area of the bar functions as the main adhesion criterion. Hereby a good cooperation between the traditional reinforcement and the ribbed plate is ensured and the adhesion is at a sufficient level. A practical distance between the corrugations for corrugations 3 about 1.5 mm high could be about 20 mm and the length approx. 30 mm depending on the dimensions of the ribs 2.

It has been found that a composite slab manufactured with a ribbed plate according to the invention is tough to break as the steel material of the plate yields before the final breaking. It has also been found in practice by laboratory tests that the ribbed plate according to the invention shows up to 50 per cent better adhesion to concrete than the current competitors.

Figure 3:
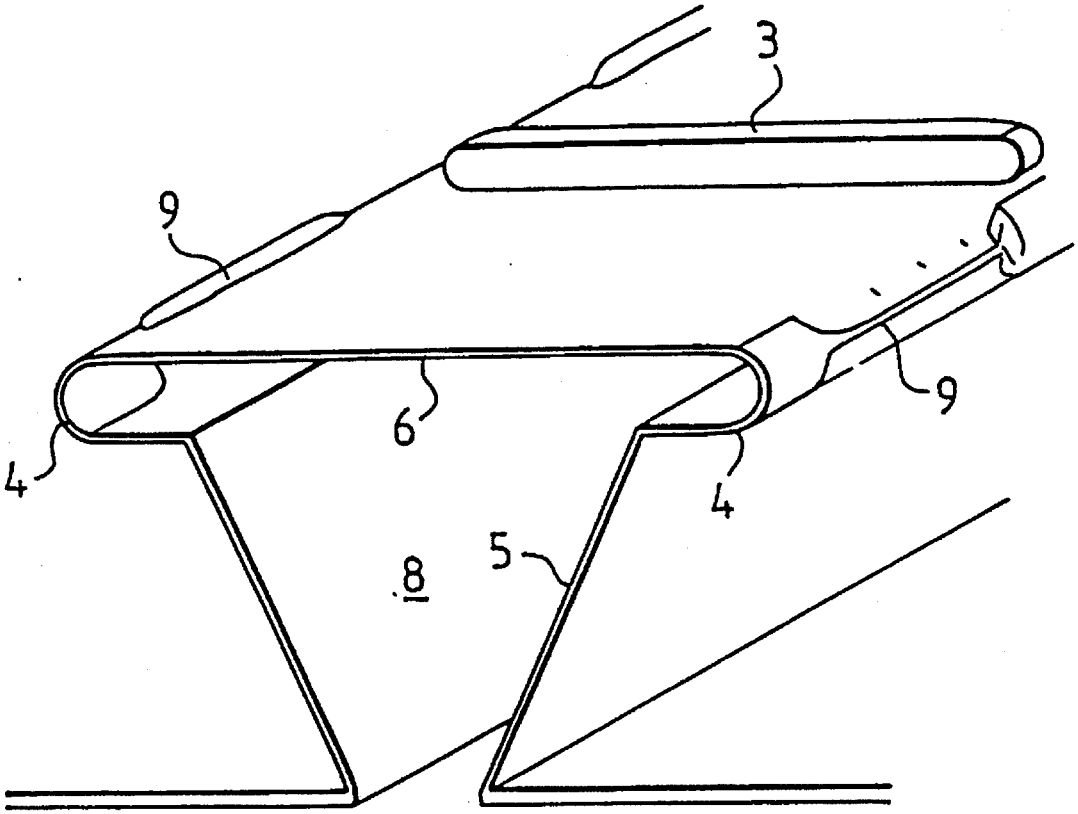
FIG. 3 illustrates another embodiment of the ribbed plate of the invention.

FIG. 3 illustrates an embodiment of the rib 8 of the ribbed plate according to the invention. Deformations 9 have been made in the protruding, longitudinal corrugations 4, which deformations improve the adhesion of the ribbed plate to the concrete.

Figure 4:
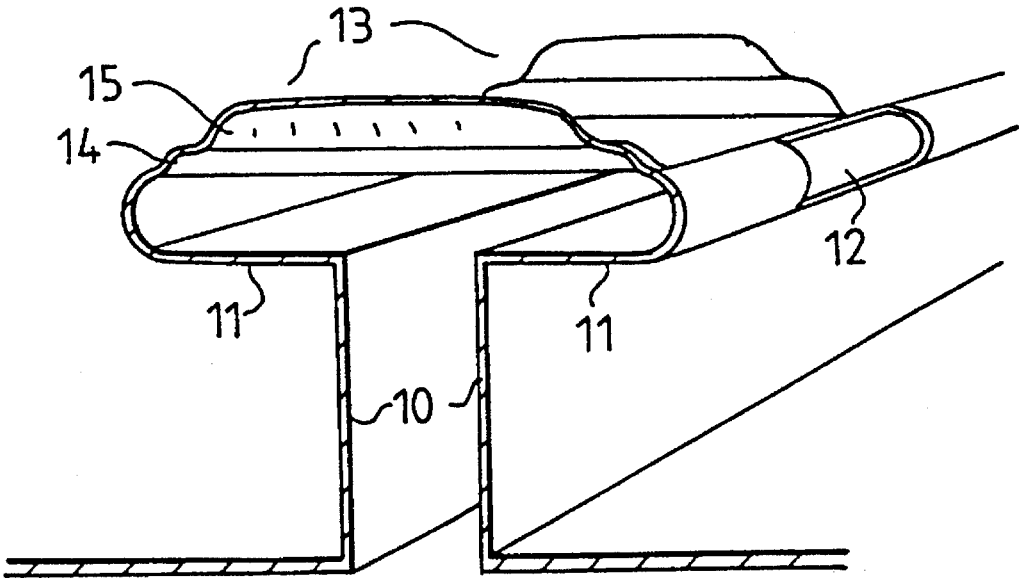
FIG. 4 illustrates yet another embodiment of the ribbed plate of the invention.

FIG. 4 illustrates by way of example some other alternatives that can be applied in the ribbed plate according to the invention. In the plate of FIG. 4 the rib is not dovetail-formed, instead the web portions 10 are vertical. Additionally, the protruding, longitudinal corrugations 11 have been made discontinuous. The discontinuities 12 of the corrugations 11 increase the adhesion area of the ribbed plate to the concrete. In addition, the transverse corrugations 13 may be formed as a base portion 14 with a lower profile and a middle portion 15 with a higher profile in order to achieve a greater height and thus additional adhesion also in this respect.

Finally it can be stated that because of the development of building materials and the properties of the ribbed plate according to the invention it is fully possible to replace the traditional steel material of ribbed plates at least in some building areas by another metal, for example, aluminium, or by a material of a totally different kind, for example, plastic composite.

For one skilled in the art it is obvious that the various embodiments of the invention are not restricted to the above examples but they can be varied within the scope of the attached claims.

We claim:

1. A ribbed plate for a composite slab, comprising:

an essentially planar plate;

protruding ribs formed in the essentially planar plate;

said protruding ribs including spaced apart side walls connected to each other by an upper flange;

said upper flange being surface profiled in order to achieve better adhesion between the ribbed plate and concrete of the composite slab;

the surface profiling of the upper flange of each rib including spaced apart transverse corrugations extending across the upper flange;

a junction of respective said side walls and the upper flange including a longitudinal protrusion with an essentially U-shaped cross-section; and the transverse corrugations being supported on the longitudinal protrusions and extending over them.

2. A ribbed plate according to claim 1, wherein the transverse corrugations are formed with a two-phase design as a base portion with a lower profile and a middle portion with a higher profile.

3. The ribbed plate according to claim 1, wherein the spaced apart side walls diverge toward the upper flange.

4. The ribbed plate according to claim 1, wherein the spaced apart side walls are parallel.

5. The ribbed plate according to claim 1, wherein the plate is made of a non-ferritic metal.

6. The ribbed plate according to claim 5, wherein the metal is aluminum.

7. The ribbed plate according to claim 1, wherein the plate is made of plastic composite.

8. A ribbed plate for a composite slab, comprising:

an essentially planar plate;

protruding ribs formed in the essentially planar plate;

said protruding ribs including spaced apart side walls connected to each other by an upper flange;

said upper flange being surface profiled in order to achieve better adhesion between the ribbed plate and concrete of the composite slab;

the surface profiling of the upper flange of each rib including spaced apart transverse corrugations extending across the upper flange;

a junction of respective said side walls and the upper flange including a longitudinal protrusion with an essentially U-shaped cross-section;

the transverse corrugations being supported on the longitudinal protrusions and extending over them; and the longitudinal protrusions being provided with deformations.

9. A ribbed plate according to claim 8, wherein the transverse corrugations are formed with a two-phase design as a base portion with a lower profile and a middle portion with a higher profile.

10. The ribbed plate according to claim 8, wherein the plate is made of a non-ferritic metal.

11. The ribbed plate according to claim 8, wherein the plate is made of plastic composite.

12. A ribbed plate for a composite slab, comprising:

an essentially planar plate;

protruding ribs formed in the essentially planar plate;

said protruding ribs including spaced apart side walls connected to each other by an upper flange;

said upper flange being surface profiled in order to achieve better adhesion between the ribbed plate and concrete of the composite slab;

the surface profiling of the upper flange of each rib including spaced apart transverse corrugations extending across the upper flange;

a junction of the side wall and the upper flange including a longitudinal protrusion with an essentially U-shaped cross-section;

the transverse corrugations being supported on the longitudinal protrusions and extending over them; and the longitudinal protrusions being discontinuous.

13. A ribbed plate according to claim 12, wherein the transverse corrugations are formed with a two-phase design as a base portion with a lower profile and a middle portion with a higher profile.

14. The ribbed plate according to claim 12, wherein the plate is made of a non-ferritic metal.

15. The ribbed plate according to claim 12, wherein the plate is made of plastic composite.

* * * * *